US012559336B2

(12) United States Patent
Tsuchiya

(10) Patent No.: US 12,559,336 B2
(45) Date of Patent: Feb. 24, 2026

(54) IMAGE FORMING SYSTEM

(71) Applicant: KYOCERA Document Solutions Inc., Osaka (JP)

(72) Inventor: Hiroaki Tsuchiya, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 50 days.

(21) Appl. No.: 18/642,732

(22) Filed: Apr. 22, 2024

(65) Prior Publication Data

US 2024/0359931 A1 Oct. 31, 2024

(30) Foreign Application Priority Data

Apr. 28, 2023 (JP) ..... 2023-074748

(51) Int. Cl.

| | |
|---|---|
| ***B65H 29/24*** | (2006.01) |
| ***B65H 3/48*** | (2006.01) |
| ***B65H 5/22*** | (2006.01) |
| ***B65H 5/38*** | (2006.01) |
| ***B65H 29/52*** | (2006.01) |

(52) U.S. Cl.

CPC ..... *B65H 29/242* (2013.01); *B65H 3/48* (2013.01); *B65H 5/224* (2013.01); *B65H 5/38* (2013.01); *B65H 29/245* (2013.01); *B65H 29/52* (2013.01); *B65H 2406/122* (2013.01)

(58) Field of Classification Search

CPC . B65H 3/48; B65H 5/22; B65H 5/224; B65H 5/228; B65H 5/36; B65H 5/38; B65H 11/005; B65H 29/242; B65H 29/245; B65H 29/246; B65H 29/247; B65H 29/248; B65H 29/52; B65H 2404/61; B65H 2404/611; B65H 2404/6111; B65H 2404/612; B65H 2406/12; B65H 2406/121; B65H 2406/122; B41J 11/007

See application file for complete search history.

(56) References Cited

U.S. PATENT DOCUMENTS

| | | | | |
|---|---|---|---|---|
| 5,506,670 | A | 4/1996 | Hatano | |
| 2016/0152429 | A1* | 6/2016 | La Vos | B41J 11/0085 271/225 |
| 2021/0339971 | A1* | 11/2021 | Llorach To | B41J 11/007 |

FOREIGN PATENT DOCUMENTS

| | | | | |
|---|---|---|---|---|
| JP | 57121542 | A | * 7/1982 | B65H 5/38 |
| JP | 57166259 | A | * 10/1982 | B65H 29/18 |
| JP | S60-122642 | A | 7/1985 | |
| JP | H02-132070 | A | 5/1990 | |
| JP | H06-219578 | A | 8/1994 | |
| JP | H07-277605 | A | 10/1995 | |
| JP | 2000-103535 | A | 4/2000 | |

* cited by examiner

*Primary Examiner* — Prasad V Gokhale

(74) *Attorney, Agent, or Firm* — Studebaker Brackett PLLC

(57) ABSTRACT

An image forming system includes a conveying member which conveys a sheet along a conveying direction; and a separation device which separates the sheet from the conveying member at a separation position. The separation device includes an air flow generating part and a duct. The air flow generating part generate an air flow. The duct which blows the air flow generated by the air flow generation part, from a position above the sheet to a downstream side in the conveying direction at the separation position.

4 Claims, 3 Drawing Sheets

IMAGE FORMING SYSTEM

INCORPORATION BY REFERENCE

This application is based on and claims the benefit of priority from Japanese patent application No. 2023-074748 filed on Apr. 28, 2023, which is incorporated by reference in its entirety.

BACKGROUND

The present disclosure relates to an image forming system including a sheet separation device which separates a sheet from a conveying member.

In an inkjet image forming apparatus, a sheet is usually conveyed by an endless conveying belt. The sheet is separated from the conveying belt and then conveyed to the next process. As a method of separating the sheet from the conveying belt, a method of curvature-separating the sheet using a roller on which the conveying belt is wound or a method of using a separating claw are known.

However, when the diameter of the roller is large, it is impossible to effectively curvature-separate the sheet of low rigidity such as a plain paper. In addition, a large number of through-holes are formed in the conveying belt, and a negative pressure is generated in the through-holes such that the sheet is conveyed while being attracted to the conveying belt. Therefore, the tip of the separating claw may be caught in the through-hole, and it is thus impossible to use the separating claw.

Alternatively, a mechanism for separating the sheet from the conveying member by using force of wind is also known. The mechanism can be roughly divided into two methods: a method of separating the sheet by attracting the sheet using the force of wind; and a method of separating the front end portion of the sheet by applying wind from the downstream side to the upstream side in the conveying direction of the sheet.

However, in the case of an inkjet image forming apparatus, the image formed surface of the sheet just after the image formation is not sufficiently dried. In the method of separating the sheet by attracting the sheet using the force of wind, the member attracting the sheet is brought into contact with the surface (image formed surface) of the sheet. Further, in the method for separating the front end portion of the sheet, when the sheet to be conveyed is one, the behavior of the sheet after the separation is unstable, and there is a high possibility that the image formed surface is brought into contact with the guide member or the like disposed near the sheet. Therefore, these methods cannot be applied to the sheet just after the image formation by the inkjet method.

SUMMARY

An image forming system according to the present disclosure includes a conveying member which conveys a sheet along a conveying direction; and a separation device which separates the sheet from the conveying member at a separation position. The separation device includes an air flow generating part and a duct. The air flow generating part generate an air flow. The duct which blows the air flow generated by the air flow generation part, from a position above the sheet to a downstream side in the conveying direction at the separation position.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the drawings, an image forming system according to one embodiment of the present disclosure will be described.

Figure 1:
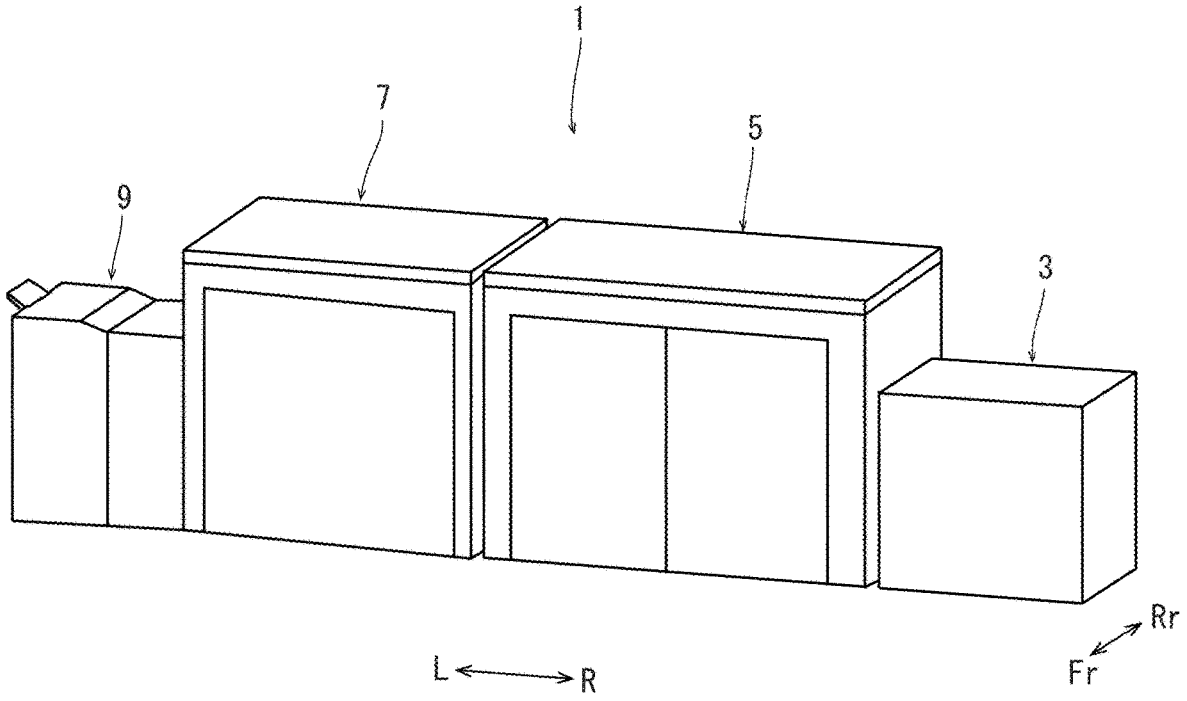
FIG. 1 is a perspective view schematically showing an image forming system according to one embodiment of the present disclosure.

First, with reference to FIG. 1, the image forming system 1 will be described. FIG. 1 is a perspective view showing the image forming system 1. L, R, Fr, and Rr are attached to each drawing as appropriate indicate the left side, right side, front side, and rear side of the image forming system 1, respectively.

The image forming system 1 includes a sheet feeding device 3, an image forming device 5, a drying device 7, and a post-processing device 9. The sheet feeding device 3 accommodates the sheet and feeds the sheet to the image forming device 5. The image forming device 5 is disposed on the left side of the sheet feeding device 3, and forms an image on the sheet fed from the sheet feeding device 3 by, for example, an inkjet method based on image data inputted from an external computer. The drying device 7 is disposed on the left side of the image forming device 5, and dries the sheet on which the image is formed while conveying the sheet. The post-processing device 9 is disposed on the left side of the drying device 7, and performs a post-processing on the sheet dried by the drying device 7.

Figure 2:
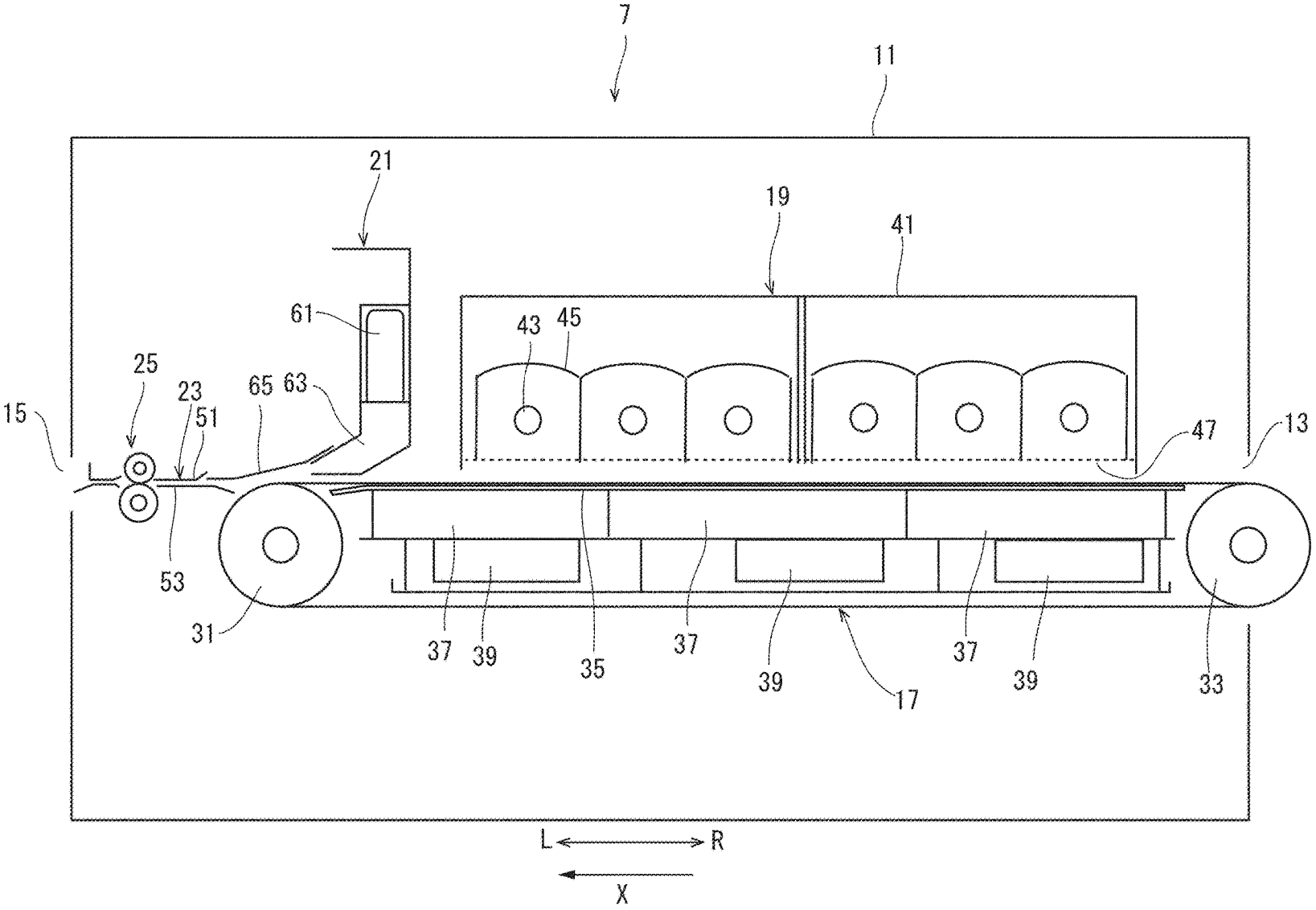
FIG. 2 is a front view schematically showing an internal structure of a drying apparatus according to the embodiment of the present disclosure.

Next, with reference to FIG. 2, the drying device 7 will be described. FIG. 2 is a front view schematically showing an internal structure of the drying device 7.

On the right side surface of the housing 11 of the drying device 7, a receive port 13 through which the sheet discharged from the image forming device 5 is received is formed. On the left side surface of the housing 11, a discharge port 15 through which the sheet is discharged to the post-processing device 9 is formed. Inside the housing 11, a conveying belt 17, a dryer 19, a sheet separation device 21, a discharge guide 23, and a discharge roller 25 are provided.

The conveying belt 17 is an endless belt in which a number of through-holes penetrating in the thickness direction are formed. The conveying belt 17 is wound around a driving roller 31 and a driven roller 33 spaced apart in the left-and-right direction. When the driving roller 31 is rotated, the conveying belt 17 travels in the counterclockwise direction of FIG. 2. The conveying belt 17 traveling along the upper traveling track forms a conveyance path along which the sheet received through the receive port 13 is conveyed along the conveying direction X toward the discharge port 15. The conveying belt 17 is an example of the conveying member in the present disclosure.

A conveying plate 35, a plurality of suction chambers 37, and a plurality of suction devices 39 are disposed in a hollow space of the conveying belt 17. The conveying plate 35 is disposed between the rollers so as to face the inner surface of the conveying belt 17 traveling along the upper traveling track. The most downstream end portion 35*a* of the conveying plate 35 in the conveying direction X is located on the upstream side of the driving roller 31 in the conveying direction X. The conveying plate 35 has a number of through-holes penetrating in the thickness direction. The suction chambers 37 are arranged below the conveying plate 35 along the conveying direction X. The suction device 39 is disposed below the suction chamber 37 to generate negative pressure in the suction chamber 37. When the negative pressure is generated in the suction chamber 37, a negative pressure is generated in the through-holes of the conveying plate 35 and the through-holes of the conveying belt 17 traveling along the upper traveling track, and the sheet is attracted to the conveying belt 17.

The dryer 19 is disposed above the upper traveling track of the conveying belt 17. The dryer 19 includes a housing 41 whose lower surface is opened, a plurality of heaters 43 housed in the housing 41 and arranged along the conveying direction X, a plurality of reflectors 45 provided for the heaters 43, and a protection net 47 covering the lower opened surface of the housing 41. A heat ray emitted from the heater 43 is reflected by the reflector 45 and irradiates the sheet conveyed by the conveying belt 17 to dry the image formed surface of the sheet.

The sheet separation device 21 is disposed on the downstream side of the dryer 19 in the conveying direction X to separate the sheet from the conveying belt 17. The sheet separation device 21 will be described later.

The discharge guide 23 is disposed on the downstream side of the sheet separation device 21 in the conveying direction X, and has an upper guide plate 51 and a lower guide plate 53 disposed with a predetermined gap in the upper-and-lower direction. The discharge guide 23 guides the sheet separated from the conveying belt 17 by the sheet separation device 21.

The discharge roller 25 is disposed on the downstream side of the discharge guide 23 in the conveying direction X, and conveys the sheet guided along the discharge guide 23 to the discharge port 15.

Figure 3:
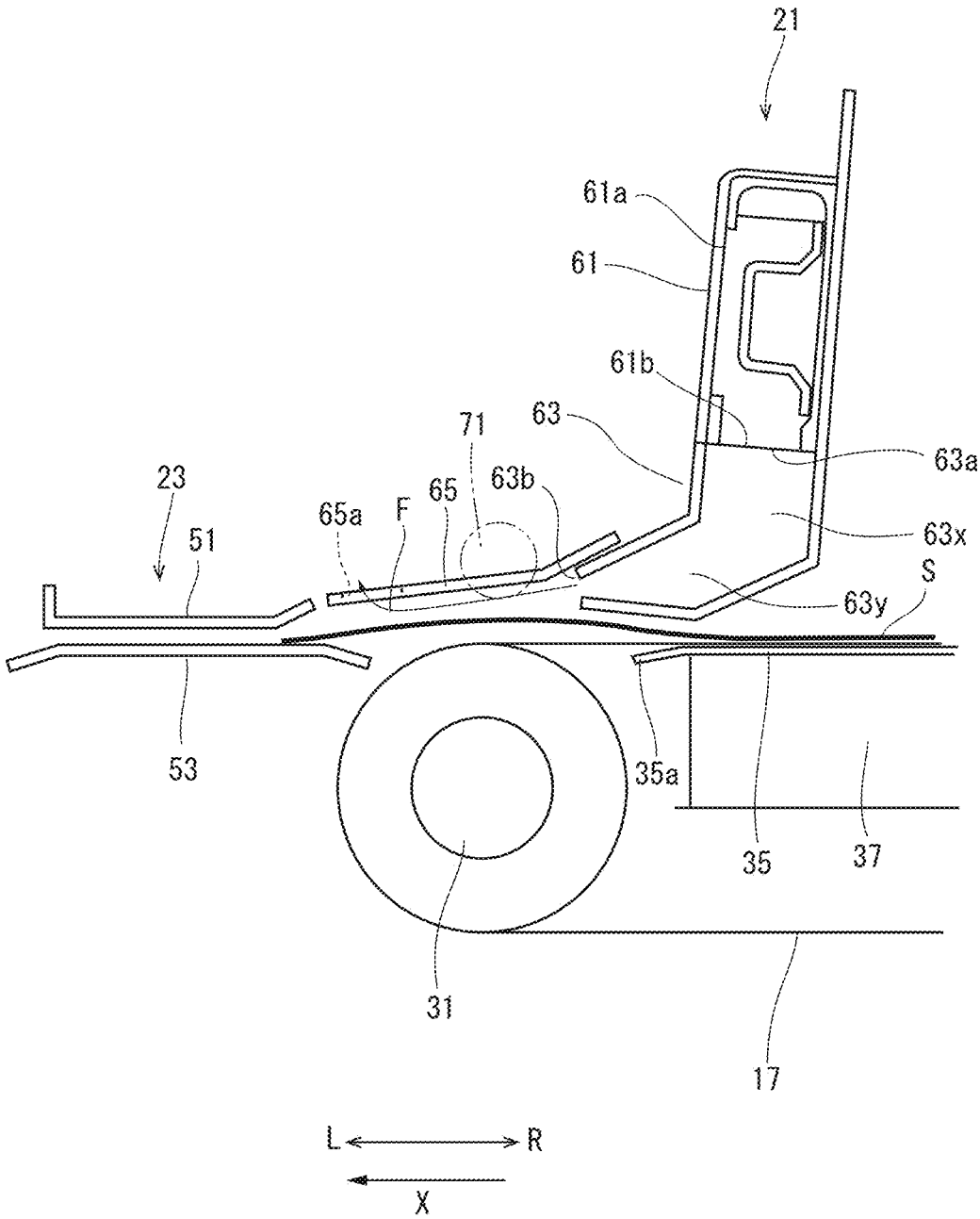
FIG. 3 is a view explaining a sheet separation operation by a sheet separation device in the image forming system according to the embodiment of the present disclosure.

Next, the sheet separation device 21 will be described with reference to FIG. 2 and FIG. 3. FIG. 3 is a view explaining the sheet separation operation by the sheet separation device 21. The sheet separation device 21 includes a fan 61 as the air flow generating part for generating air flow, a duct 63 through which the air flow generated by the fan 61 passes, and a duct guide 65 connected to the duct 63.

The fan 61 is, for example, a sirocco fan and, as shown in FIG. 3, has an intake port 61*a* for sucking air and an outlet port 61*b* for blowing the sucked air. The fan 61 is disposed on the downstream side of the dryer 19 in the conveying direction X in a posture in which the outlet port 61*b* faces downward. In this embodiment, two fans 61 are installed along a width direction intersecting the conveying direction X.

The duct 63 is formed of an upper plate and a lower plate facing in the upper-and-lower direction and side plates facing in the left-and-right direction. The duct 63 includes an upstream part 63*x* extending downward from an inlet opening 63*a* and a downstream part 63*y* inclined in the downstream side of the conveying direction X from the upstream part 63*x* toward an outlet opening 63*b*. The inlet opening 63*a* is connected to the outlet port 61*b* of the fan 61. The outlet opening 63*b* is located on the downstream side of the conveying plate 35 in the conveying direction X, on the upstream side of the contact area between the driving roller 31 and the conveying belt 17 in the conveying direction X, and above the conveying belt 17 traveling along the upper traveling track, and opens to the downstream side of the conveying direction X. As one example, the outlet opening 63*b* is located 1 cm above the conveying belt 17 traveling along the upper traveling track.

The downstream part 63*y* is formed in a ruling pen-like shape. That is, the downstream part 63*y* is formed so that the cross-sectional area gradually narrows toward the outlet opening 63*b*. In other words, the downstream part 63*y* is formed so that the distance between the upper plate and the lower plate gradually narrows toward the outlet opening 63*b*. Further, the lower plate of the downstream part 63*y* is inclined slightly upward toward the outlet opening 63*b*. In one example, the lower plate is inclined 5 degrees upward with reference to the horizontal plane.

The duct guide 65 is disposed above the driving roller 31 between the upper plate of the duct 63 and the upper guide plate 51. A plurality of gaps 65*a* along the conveying direction X are formed in the duct guide 65 at predetermined intervals in the width direction. The duct guide 65 is inclined slightly downward toward the upper guide plate 51.

The sheet separation operation of the sheet separation device 21 having the above configuration will be described with reference to FIG. 3. As described above, the sheet S is conveyed while being attracted to the conveying belt 17. However, since the suction chamber 37 is not provided between the most downstream end portion 35*a* of the conveying plate 35 and the driving roller 31, the force to attract the sheet to the conveying belt 17 decreases or becomes 0 (zero) after the sheet passes through the conveying plate 35. Therefore, the sheet separation device 21 separates the sheet S from the conveying belt 17 between the most downstream end portion 35*a* of the conveying plate 35 and the driving roller 31. That is, the separation position of the sheet in the present disclosure is a position between the most downstream end portion 35*a* of the conveying plate 35 and the driving roller 31.

While the drying device 7 is being driven, the fan 61 continues to be driven. Thus, air is taken in from the intake port 61*a* and blown from the outlet port 61*b*. The blown air (air flow) enters the duct 63 from the inlet opening 63*a* of the duct 63 and is blown from the outlet opening 63*b*. The blown air (airflow) F flows along the duct guide 65 toward the downstream side of the conveying direction X above the sheet S conveyed by the conveying belt 17, as shown by the arrow in FIG. 3. That is, the blown air flows about 1 cm above the sheet S toward the downstream side almost parallel to the sheet S. In other words, a layer of air exists between the sheet S and the air flow F.

At the separation position of the sheet S, while the air in the space in the through-holes of the conveying belt 17 is in a stationary state, the air flow F exists in the space above the sheet S. As a result, an air pressure in the space above the sheet S is lower than the space in the through-holes of the conveying belt 17, which is the space below the sheet S. Then, the sheet S is pulled upward and floats from the conveying belt 17. Then, it is conveyed to the downstream side along the air flow F. However, since the air flow F exists between the duct guide 65 and the sheet S, the sheet S is not in contact with the duct guide 65.

The duct guide 65 has a gap 65*a* which communicates the outside and the inside of the duct guide 65 and through which the air passes. Therefore, the air flow F blown from the duct 63 blows from the inside of the duct guide 65 to the outside of the duct guide 65 through the gap 65*a*. Then, since the air flow F which attracts the sheet S disappears, the sheet S falls on the lower guide plate 53 by its own weight. Thereafter, the sheet S is guided to the discharge roller 25 along the discharge guide 23, and is fed to the discharge port 15 by the discharge roller 25.

As described above, according to the present disclosure, by forming the air flow toward the downstream side of the conveying direction X above the sheet S conveyed by the conveying belt 17, the sheet S is attracted to the air flow and separated from the conveying belt 17. At this time, since the air flow exists between the sheet S and the duct guide 65, the sheet S does not come into contact with the duct guide 65. Thus, the sheet S can be surely separated from the conveying belt 17 without contaminating the image formed surface.

In particular, the present disclosure is more suitable in the case where it is difficult to curvature-separate the sheet by the roller or in the case where the separation claw cannot be used because of the through-holes of the conveying belt 17.

In the present disclosure, since a space preferably exists below the sheet S, the large number of through-holes penetrating through the conveying belt 17 in the thickness direction are formed. Alternatively, the conveying belt 17 may be made of mesh material. Further, a plurality of grooves along the circumferential direction may be formed on the surface of the driving roller 31. In this case, the force for attracting the sheet S to the air flow F can be increased. Also, the suction device 39 may be controlled so that the pressure in the most downstream suction chamber 37 in the conveying direction X is lower than that in the other suction chambers 37, or is 0 (zero).

As shown in FIG. 3, a dirk-like roller 71 may be provided in the duct guide 65. The roller 71 protrudes slightly downward from the lower surface of the duct guide 65. In this case, the floated sheet S is prevented from being in contact with the duct guide 65 more surely. Since the roller 71 is dirk-like and the contact area between the image formed surface of the sheet S and the roller 71 is very narrow, the image formed surface is not disturbed even if the image formed surface is in contact with the roller 71.

In the present disclosure, the duct guide 65 is provided on the downstream side of the duct 63, but the duct guide 65 is not necessarily required. However, it is preferable to provide the duct guide 65, since the stable air flow F along the conveying direction X can be formed.

In addition, the duct 63 may be provided with a straightening plate to equalize the airflow passing through the duct 63 in the width direction.

Although the sheet separation device 21 provided in the drying device 7 has been described in the present disclosure, the sheet separation device 21 may also be provided in the image forming device 5.

Since the above description of embodiments of the present disclosure describes preferred embodiments in the image forming apparatus according to the present disclosure, various technically preferable limitations may be attached to the description, but the scope of the present disclosure is not limited to these aspects unless there is a description specifically limiting the present disclosure.

The invention claimed is:

1. An image forming system comprising:

a conveying member which conveys a sheet along a conveying direction; and a separation device which separates the sheet from the conveying member at a separation position, wherein the separation device includes:

an air flow generating part which generates an air flow;

a duct which blows the air flow generated by the air flow generation part, from a position above the sheet to a downstream side in the conveying direction at the separation position; and a duct guide which guides the air flow passed through the duct in the conveying direction above the sheet.

2. The image forming system according to claim 1, wherein the duct guide has a gap through which the air flow in the duct guide can pass to an outside of the duct guide.

3. An image forming system comprising:

a conveying member which is an endless belt having a large number of through-holes penetrating in a thickness direction, and conveys a sheet along a conveying direction;

a suction device which generates a negative pressure in the through-holes to attract the sheet to the conveying belt is provided;

a separation device which separates the sheet from the conveying member at a separation position;

rollers spaced apart in the conveying direction and around which the conveying member is wound; and a conveying plate disposed to face an inner surface of the conveying member, wherein the separation device includes:

an air flow generating part which generates an air flow; and a duct which blows the air flow generated by the air flow generation part, from a position above the sheet to a downstream side in the conveying direction at the separation position, the separation position is a position between the roller disposed on a downstream side in the conveying direction and a downstream end portion of the conveying plate, and the suction device is not provided at the separation position, and a force for attracting the sheet to the conveying belt at the separation position is lower than that at other positions or zero.

4. An image forming system comprising:

a conveying member which conveys a sheet along a conveying direction; and a separation device which separates the sheet from the conveying member at a separation position, wherein the separation device includes:

an air flow generating part which generates an air flow; and a duct which blows the air flow generated by the air flow generation part, from a position above the sheet to a downstream side in the conveying direction at the separation position, wherein the duct includes an upstream part extending downward from an inlet opening and a downstream part inclined toward an outlet opening to a downstream side in the conveying direction, and the downstream part is formed so that a cross-sectional area gradually narrows toward the outlet opening, and a lower plate of the downstream part is inclined slightly upward toward the outlet opening.

* * * * *